US005722135A

United States Patent [19]

I-Tsung

[11] Patent Number: 5,722,135

[45] Date of Patent: Mar. 3, 1998

[54] UMBRELLA RIB FABRICATION METHOD

[76] Inventor: Fang I-Tsung, No. 176, Sec. 2, Chang Tsao Rd., Ho Mei Chen, Changhwa Hsien, Taiwan

[21] Appl. No.: 783,154

[22] Filed: Jan. 14, 1997

[51] Int. Cl.[6] ..... B23P 17/00; B21F 41/00; B29C 53/00

[52] U.S. Cl. ..... 29/25; 29/417; 29/411; 264/150

[58] Field of Search ..... 29/411, 417, 527.1, 29/25; 264/150, 152

[56] References Cited

U.S. PATENT DOCUMENTS

| | | | |
|---|---|---|---|
| 1,159,644 | 11/1915 | Brecht | 29/411 |
| 2,311,704 | 2/1943 | Simison | 29/411 |
| 3,742,985 | 7/1973 | Rubenstein . | |
| 4,231,834 | 11/1980 | Gonzalez | 264/150 |
| 4,916,786 | 4/1990 | Chollett et al. | 29/25 |
| 5,341,555 | 8/1994 | Warden et al. | 29/527.1 |
| 5,566,418 | 10/1996 | Steffen et al. . | |

*Primary Examiner*—David P. Bryant
*Assistant Examiner*—Tisa Stewart
*Attorney, Agent, or Firm*—Varndell Legal Group

[57] ABSTRACT

An umbrella fabrication method including the steps of (I) preparing a bamboo tube by cutting off nodes from a bamboo cane, (II) bonding a resin compound to the inside of the bamboo tube thus obtained, so as to obtain a resin bonded bamboo tube, and, (III) cutting the resin bonded bamboo tube into finished pieces, each finished piece having a flat bamboo base, and a resin rib body bonded to one side of the flat bamboo base.

2 Claims, 5 Drawing Sheets

UMBRELLA RIB FABRICATION METHOD

BACKGROUND AND SUMMARY OF THE INVENTION

The present invention relates to umbrella rib fabrication methods, and more particularly to an umbrella rib fabrication method which includes the step of bonding a resin compound to the inside of a bamboo tube, and the step of cutting the resin bonded bamboo tube into finished pieces, each finished piece having a flat bamboo base, and a resin rib body bonded to one side of the flat bamboo base.

FIG. 1 shows a regular umbrella frame for umbrella, which is generally comprised of a tubular metal shaft, and radial umbrella ribs pivoted to the metal shaft. These umbrella ribs are respectively made from metal strips by bending. When waste umbrellas are thrown away, the sharp edges of the umbrella ribs are harmful to wild animals, road sweepers, etc.

The present invention has been accomplished to provide an umbrella rib fabrication method which eliminates the aforesaid problem. According to one aspect of the present invention, umbrella ribs are made by: bonding a resin compound to the inside of a bamboo tube, and then cutting the resin bonded bamboo tube into finished pieces, each finished piece having a flat bamboo base, and a resin rub body bonded to one side of the flat bamboo base. According to another aspect of the present invention, the bonding resin is comprised of 95–99 wt % unsaturated resin and 1–5 wt % explosion-proof MEKPO which contains 55% ketone peroxide and 45% dimethyl phthalate.

DETAILED DESCRIPTION OF THE PREFERRED EMBODIMENT

Figure 1:
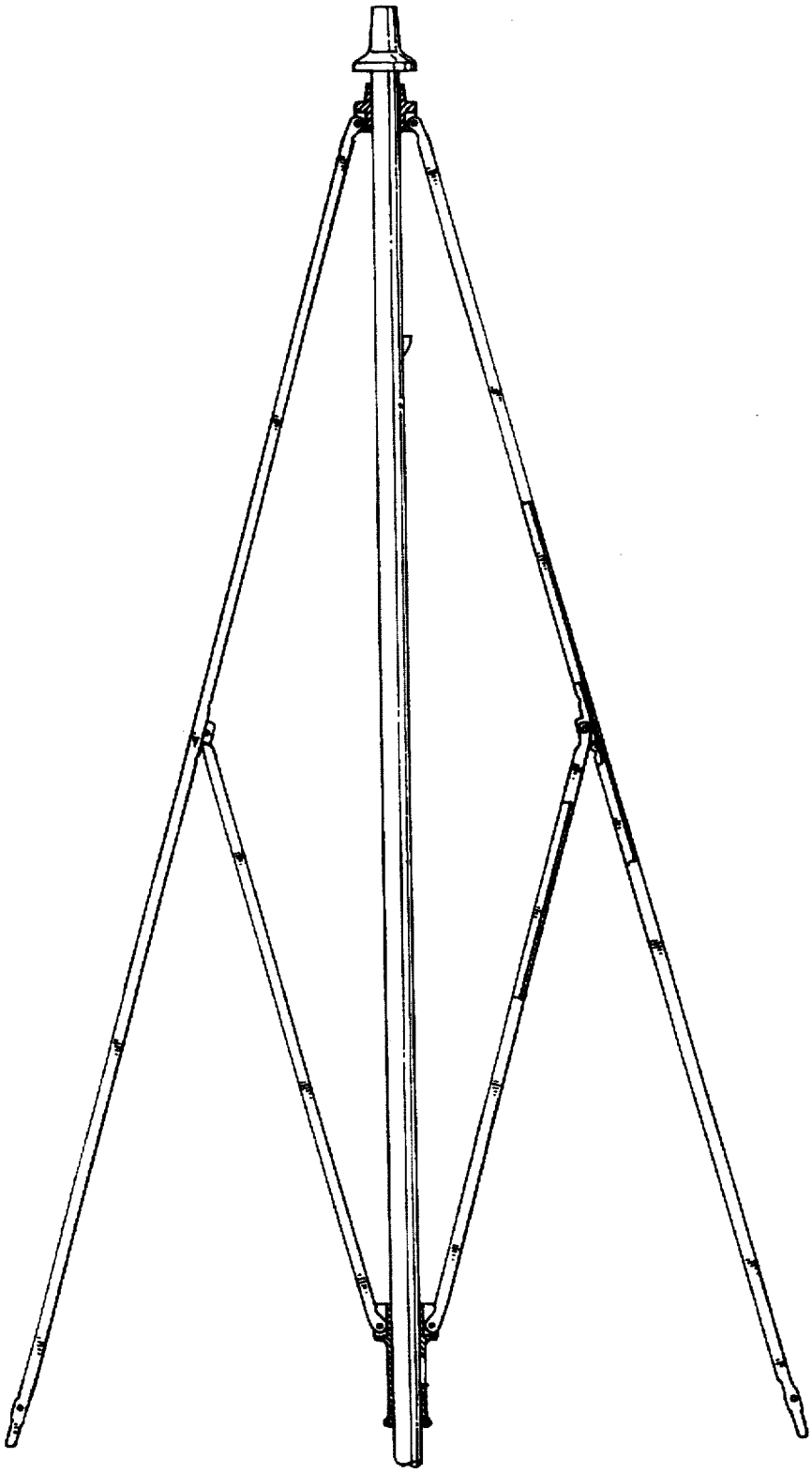
Fig . 1 PRIOR ART
FIG. 1 shows the structure of an umbrella frame according to the prior art.
Figure 2:
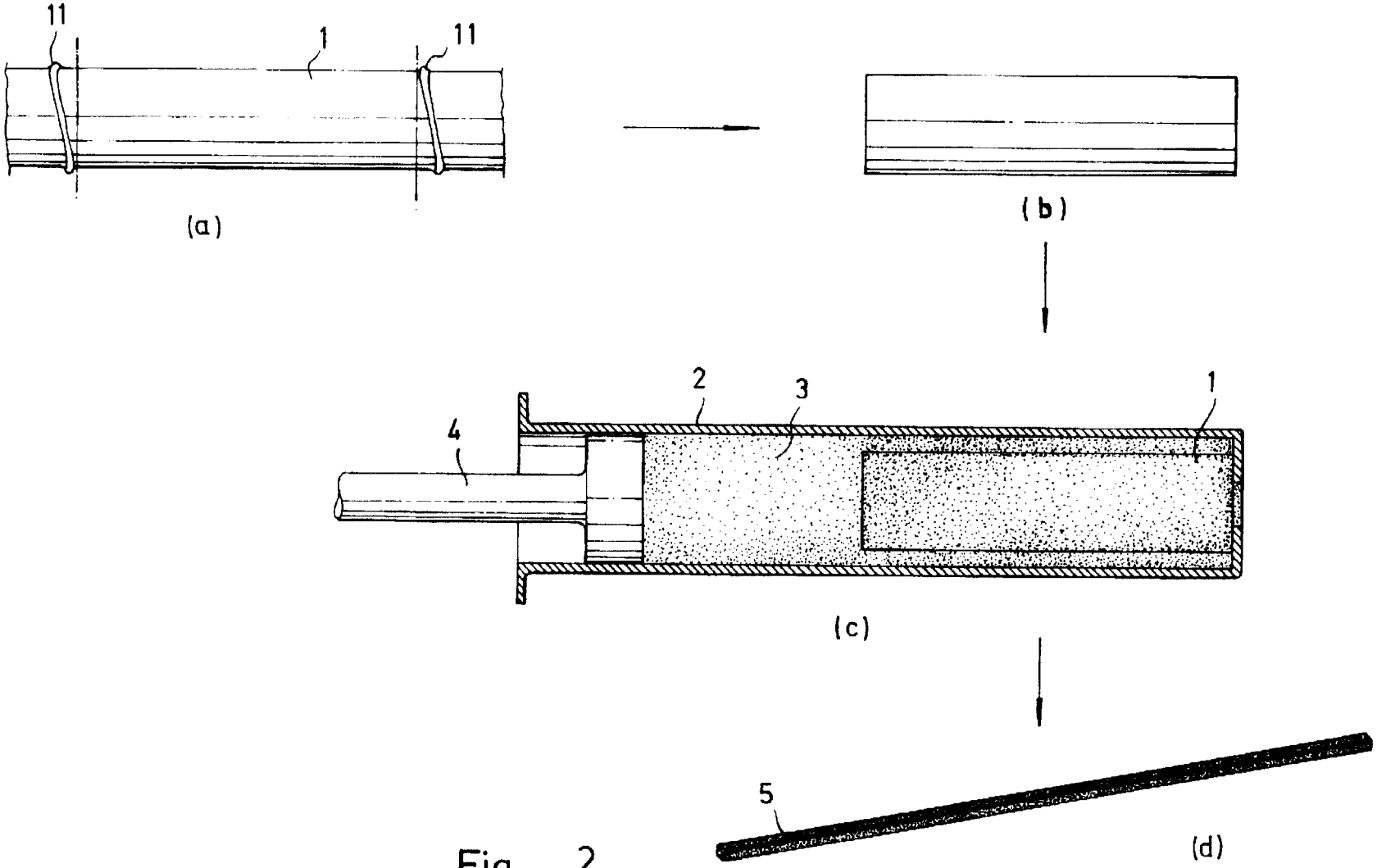
FIGS. 2(*a*)–2(*d*) show a flow chart showing the fabrication of umbrella ribs according to the present invention.

Referring to FIG. 2, an umbrella rib fabrication method in accordance with the present invention includes the steps of:

(a) preparing a bamboo cane 1;

(b) cutting off the nodes 11 of the bamboo cane 1, so as to obtain a bamboo tube;

(c) putting the bamboo tube in a cylindrical receptacle 2, then pouring a compound 3, which is obtained by mixing 95–99 wt % unsaturated resin and 1–5 wt % explosion-proof MEKPO which contains 55% ketone peroxide and 45% dimethyl phthalate, into the receptacle 2, and then driving a plunger 4 into the receptacle to compact the compound 3 and to force the compound 3 into capillaries of the bamboo tube, so as to obtain a compound bonded bamboo tube;

(d) cutting the compound bounded bamboo tube into finished ribs 5.

Figure 3:
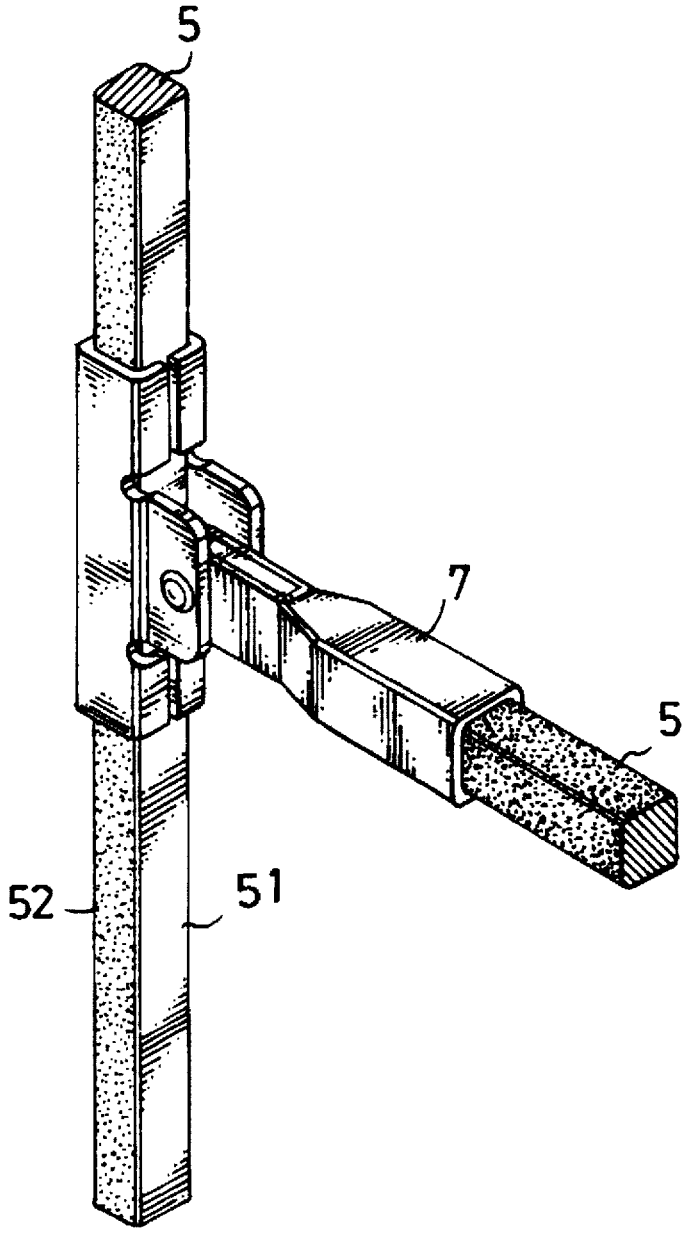
FIG. 3 shows two umbrellas ribs pivotably connected together, and a platic joint connected between the umbrella ribs according to the present invention.
Figure 4:
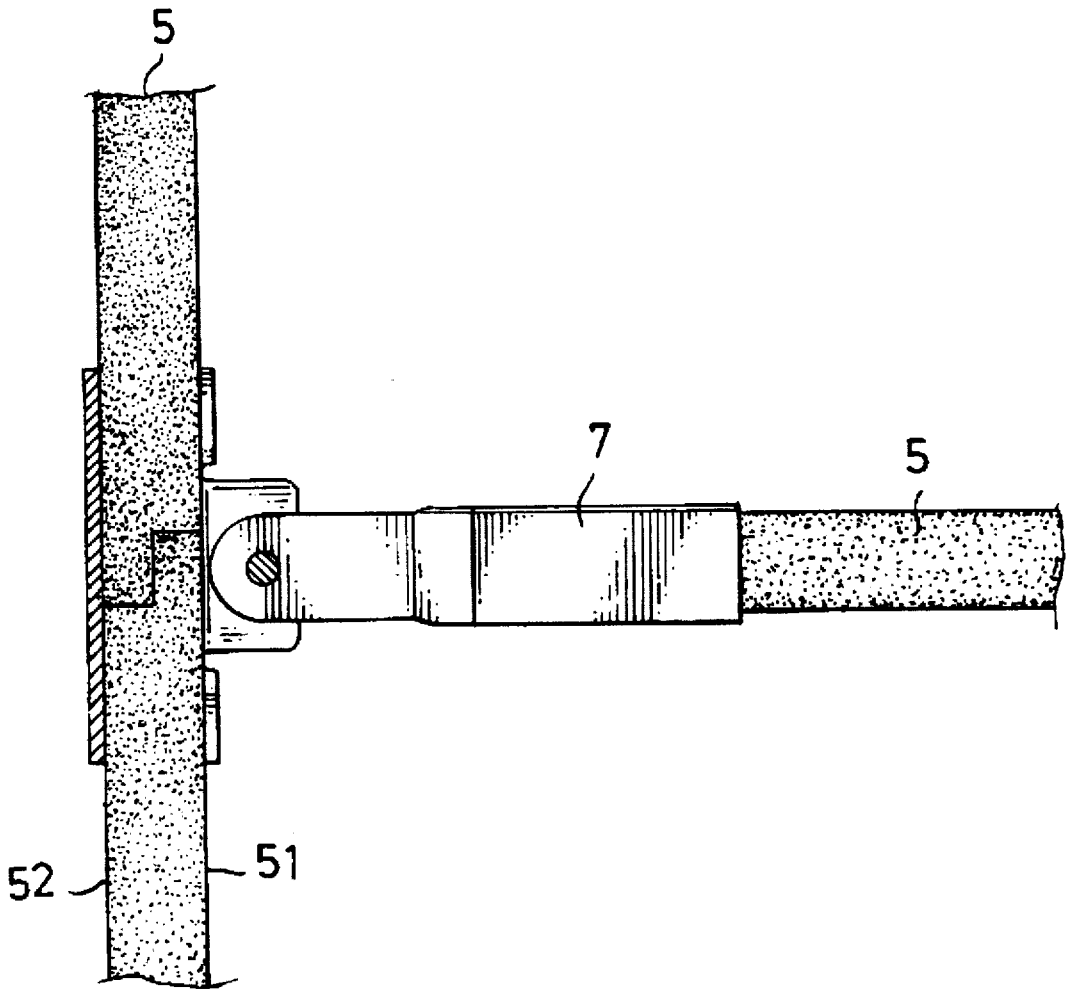
FIG. 4 is a sectional view of the assembly of FIG. 3.
Figure 5:
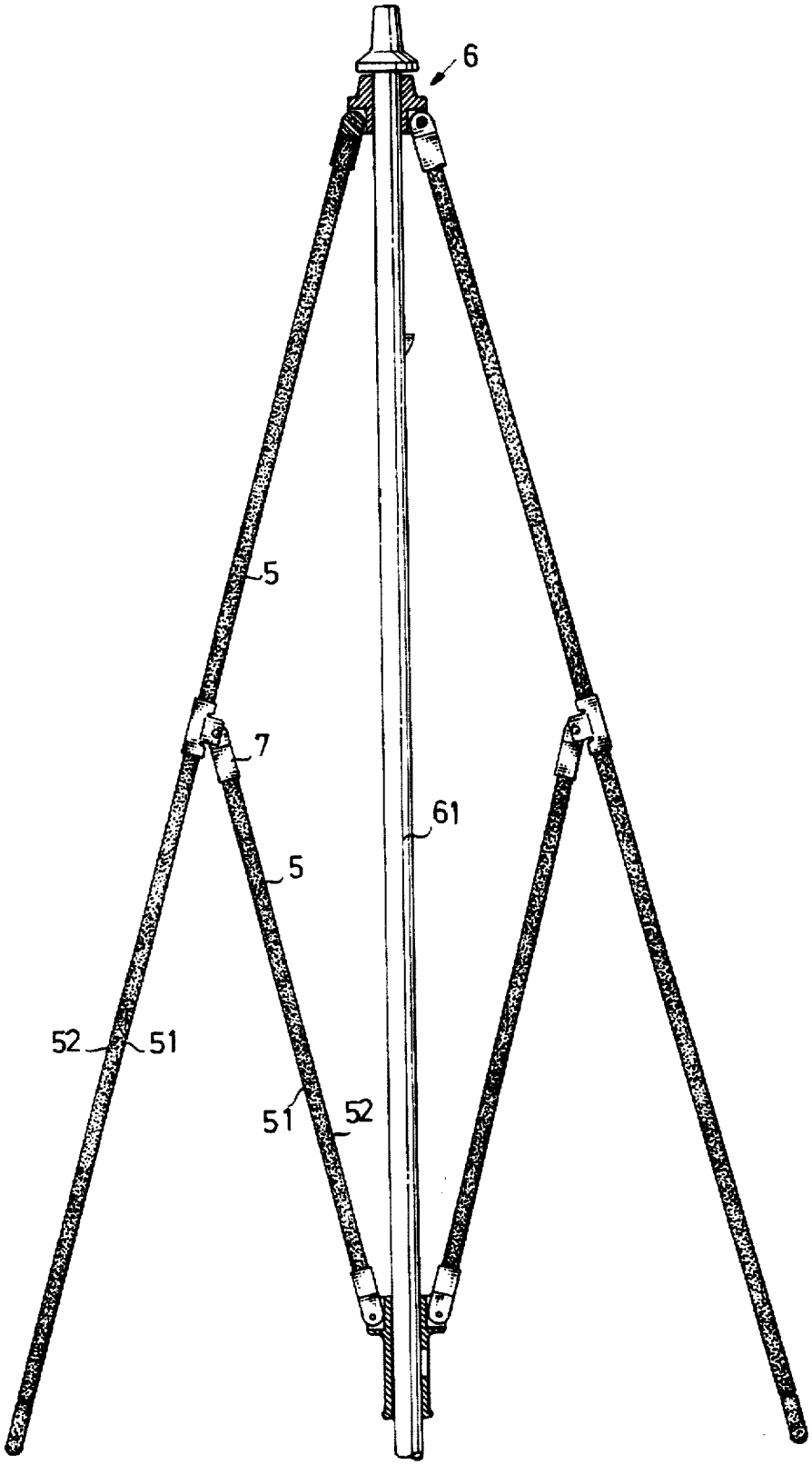
FIG. 5 shows the structure of an umbrella frame according to the present invention.

Referring to FIGS. 3, 4, and 5, the ribs 5 thus obtained are pivotably connected together by plastic joints 7 (see FIGS. 3 and 4), and then pivotably connected to a shaft 61 to form an umbrella frame 6 (see FIG. 5). As illustrated in Figures from 3 to 5, each rib 5 comprises a flat bamboo base 51, and a resin rib body 52 bonded to one side of the bamboo base 51. When the umbrella frame 6 is assembled, as shown in FIG. 5, the bamboo bases 51 of the ribs for supporting the umbrella are respectively disposed at an outer side for supporting the umbrella cover directly, and the bamboo bases 51 of the ribs which are not to be disposed in direct contact with the umbrella cover are disposed at an outer side (facing the umbrella cover). This arrangement enables the ribs 51 to quickly return to their former shape after they have been stretched.

I claim:

1. An umbrella rib fabrication method comprising the steps of:

(a) preparing a bamboo cane;

(b) cutting off nodes from said bamboo cane, so as to obtain a bamboo tube having a capillary therein;

(c) putting said bamboo tube in a cylindrical receptacle;

(d) pouring a resin compound into said receptacle;

(e) driving a plunger into said receptacle to compact said resin and to force said resin compound into said capillary of said bamboo tube, thereby obtaining a resin bonded bamboo tube; and (f) cutting said resin bonded bamboo tube into finished pieces, said finished pieces respectively having a flat bamboo base with said resin compound bonded to said flat bamboo base.

2. The umbrella rib fabrication method of claim 1 wherein said resin compound is comprised of 95–99 wt % unsaturated resin and 1–5 wt % explosion-proof MEKPO which contains 55% ketone peroxide and 45% dimethyl phthalate.

* * * * *